US011592776B2

(12) United States Patent
Watanabe

(10) Patent No.: US 11,592,776 B2
(45) Date of Patent: Feb. 28, 2023

(54) RECORDING MATERIAL PROCESSING APPARATUS AND IMAGE FORMING SYSTEM

(71) Applicant: FUJIFILM Business Innovation Corp., Tokyo (JP)

(72) Inventor: Taiki Watanabe, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/341,411

(22) Filed: Jun. 8, 2021

(65) Prior Publication Data

US 2022/0107599 A1 Apr. 7, 2022

(30) Foreign Application Priority Data

Oct. 1, 2020 (JP) ..... JP2020-166704

(51) Int. Cl.
*G03G 15/00* (2006.01)
*B65H 29/38* (2006.01)

(52) U.S. Cl.
CPC ..... *G03G 15/6529* (2013.01); *B65H 29/38* (2013.01); *G03G 15/6538* (2013.01)

(58) Field of Classification Search
CPC combination set(s) only.
See application file for complete search history.

(56) References Cited

U.S. PATENT DOCUMENTS

2002/0158405 A1* 10/2002 Nagasako ..... B65H 31/10 271/220
2010/0117292 A1* 5/2010 Iwata ..... B65H 33/08 271/163
2015/0014916 A1* 1/2015 Saito ..... B65H 31/34 271/185
2016/0176208 A1* 6/2016 Osada ..... B65H 31/38 347/104

FOREIGN PATENT DOCUMENTS

JP 2001240295 9/2001

* cited by examiner

*Primary Examiner* — Jennifer Bahls
(74) *Attorney, Agent, or Firm* — JCIPRNET

(57) ABSTRACT

A recording material processing apparatus includes a guide shaft of which an axial direction extends in a recording material width direction intersecting a discharge direction of a recording material, and an alignment unit that moves along the guide shaft, in which the alignment unit includes a bearing portion that is movably fitted onto the guide shaft, an alignment portion that is provided to be exposed at an outer side in the discharge direction and comes into contact with an end surface of the recording material that is parallel to the discharge direction from an outer side of the recording material to align a position of the end surface, an arm portion that connects the bearing portion and the alignment portion to each other, and a protruding portion that protrudes from a surface of the arm portion to a position outside the recording material in the axial direction of the guide shaft and comes into contact with a surface of a device main body, (Continued)

which is parallel to the discharge direction, in a case where an external force is applied to the alignment unit with the alignment unit being at a position close to the surface.

20 Claims, 10 Drawing Sheets

RECORDING MATERIAL PROCESSING APPARATUS AND IMAGE FORMING SYSTEM

CROSS-REFERENCE TO RELATED APPLICATIONS

This application is based on and claims priority under 35 USC 119 from Japanese Patent Application No. 2020-166704 filed Oct. 1, 2020.

BACKGROUND

(i) Technical Field

The present invention relates to a recording material processing apparatus and an image forming system.

(ii) Related Art

A sheet-shaped medium processing device that includes a discharge unit that discharges a sheet-shaped medium transported thereto, a tray onto which the sheet-shaped medium discharged by the discharge unit is loaded, and a tray moving unit that performs a sorting operation by moving the tray by a predetermined amount in a shift direction orthogonal to a sheet-shaped medium discharge direction of the discharge unit such that the sheet-shaped medium loaded onto the tray is sorted, in which an alignment unit that aligns the sheet-shaped medium loaded onto the tray is provided, the alignment unit includes a pair of alignment members for an alignment operation in which the sheet-shaped medium discharged by the discharge unit and loaded onto the tray is brought into contact with alignment portions such that two end surfaces of the sheet-shaped medium parallel to the discharge direction are interposed between the alignment portions and the positions of the end surfaces are aligned, and the alignment operation is performed such that in which a sheet-shaped medium loaded after the sorting operation is aligned at a different position from a sheet-shaped medium loaded before the sorting operation, is known (JP2001-240295A).

SUMMARY

Aspects of non-limiting embodiments of the present disclosure relate to a recording material processing apparatus and an image forming system that suppress damage to a bearing portion of an alignment unit and deformation of an alignment portion of the alignment unit in comparison with a case where the bearing portion or the alignment portion comes into contact with a device main body in a case where the alignment unit exposed to the outside is positioned close to a surface of the device main body that intersects a axial direction of a guide shaft.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording material processing apparatus including a guide shaft of which an axial direction extends in a recording material width direction intersecting a discharge direction of a recording material, and an alignment unit that moves along the guide shaft. The alignment unit includes a bearing portion that is movably fitted onto the guide shaft, an alignment portion that is provided to be exposed at an outer side in the discharge direction and comes into contact with an end surface of the recording material that is parallel to the discharge direction from an outer side of the recording material to align a position of the end surface, an arm portion that connects the bearing portion and the alignment portion to each other, and a protruding portion that protrudes from a surface of the arm portion to a position outside the recording material in the axial direction of the guide shaft and comes into contact with a surface of a device main body, which is parallel to the discharge direction, in a case where an external force is applied to the alignment unit with the alignment unit being at a position close to the surface.

BRIEF DESCRIPTION OF THE DRAWINGS

Exemplary embodiment(s) of the present invention will be described in detail based on the following figures, wherein.

DETAILED DESCRIPTION

Figure 1:
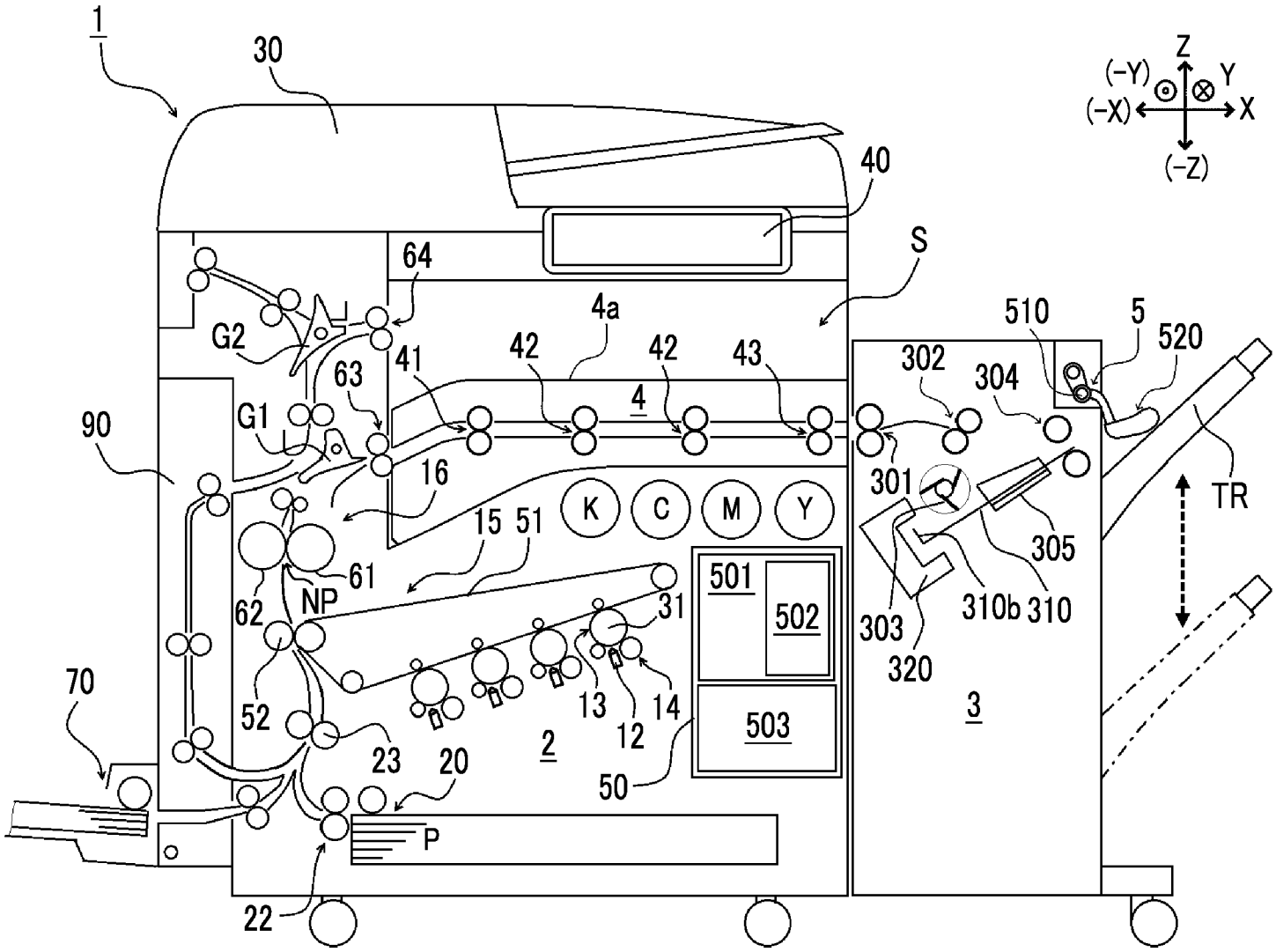
FIG. 1 is a schematic configuration view showing an image forming system according to an exemplary embodiment.

Next, the present invention will be more specifically described with reference to the drawings while using an exemplary embodiment and a specific example as follows. However, the present invention is not limited to the exemplary embodiment and the specific example.

In addition, note that, in the following description made by using the drawings, the drawings are schematic, the ratio between dimensions or the like is different from the actual ratio, and members other than members that need to be illustrated for description have been appropriately omitted for the sake of easy understanding.

Note that, in order to facilitate understanding of the following description, in the drawings, a lateral direction will be referred to as a direction X, a front-rear direction will be referred to as a direction Y, and a vertical direction will be referred to as a direction Z.

(1) Overall Configuration and Operation of Image Forming System

Figure 2:
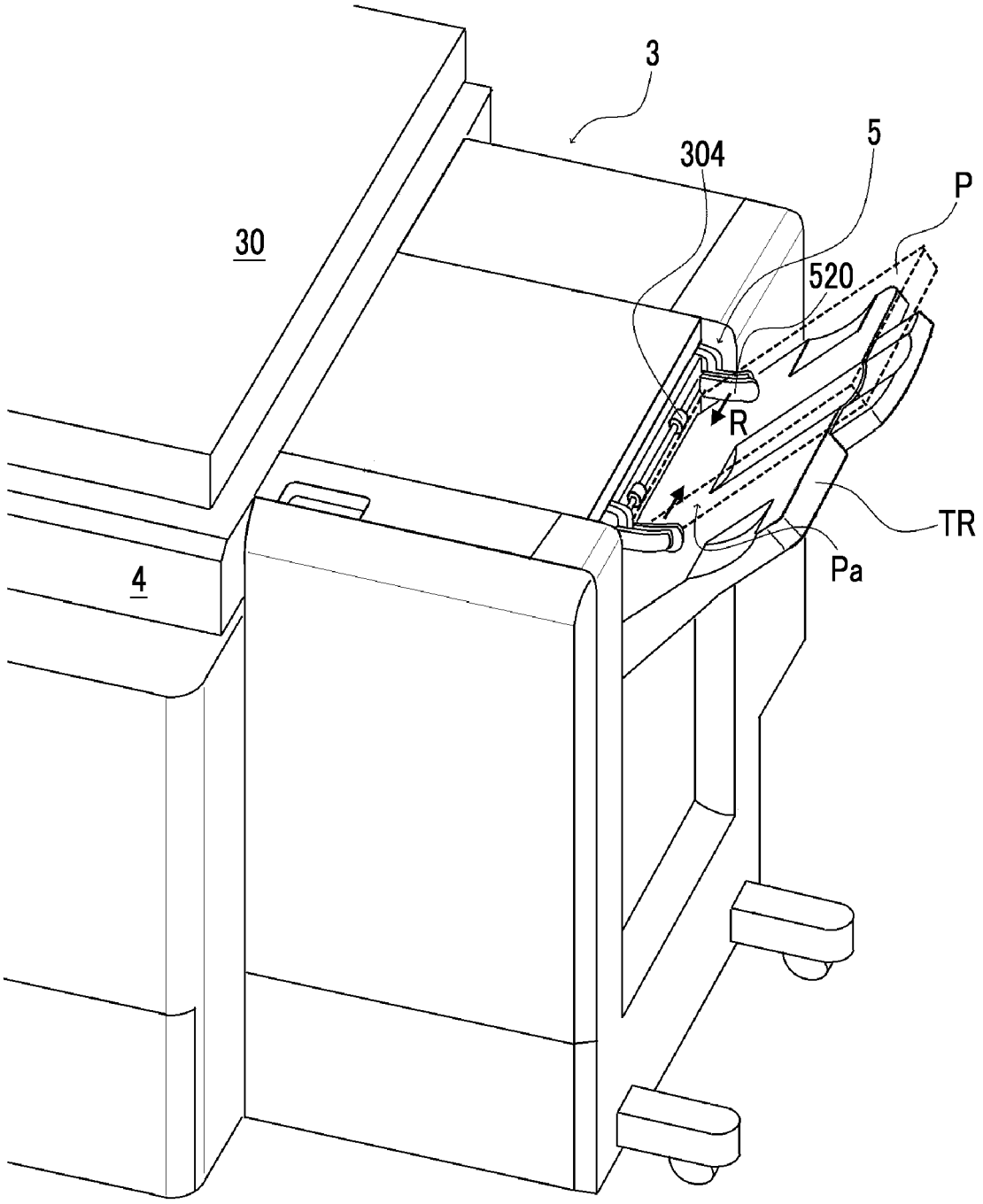
FIG. 2 is a perspective view of a post-processing device and a recording material processing apparatus as seen from above.

FIG. 1 is a schematic configuration view showing an image forming system 1 according to the present exemplary embodiment, and FIG. 2 is a perspective view of a post-processing device 3 and a recording material processing apparatus 5 as seen from above.

The image forming system 1 shown in FIG. 1 includes an image forming device 2 that forms an image on a paper sheet P as a recording material, the post-processing device 3 that performs post-processing on the paper sheet P on which an image is formed by the image forming device 2, a relay device 4 that is disposed on an upper surface of the image forming device 2 and transports the paper sheet P discharged from the image forming device 2 to the post-processing device 3, and the recording material processing apparatus 5 that aligns end surfaces of the paper sheet P subjected to the post-processing at the post-processing device 3.

Hereinafter, the overall configuration and the operation of the image forming system 1 will be described with reference to the drawings.

(1.1) Configuration and Operation of Image Forming Device

As shown in FIG. 1, the image forming device 2 includes an image forming unit 10, a paper feeding device 20 that is mounted below the image forming unit 10, a reading device 30 that is mounted above the image forming unit 10, an operation display unit 40, a control device 50, and a manual insertion paper feeding device 70 that is mounted to be positioned to the left of the image forming unit 10.

The image forming unit 10 is configured to include exposure devices 12, photoreceptor units 13, developing devices 14, a transfer device 15, and a fixing device 16, and the image forming unit 10 forms image information on the paper sheet P fed into the image forming unit 10 from the paper feeding device 20 or the manual insertion paper feeding device 70 in the form of a toner image.

The reading device 30 reads an image on the sheet with an image sensor (not shown) such as a charge coupled device (CCD) line sensor and converts the image into image data which is an electric signal.

The operation display unit 40, which is a user interface, is disposed on the front surface side of the reading device 30. The operation display unit 40 is configured by combining a liquid crystal display panel, various operation buttons, a touch panel, and the like and a user of the image forming device 2 inputs various settings and instructions via the operation display unit 40. In addition, various information is displayed to the user of the image forming device 2 via the liquid crystal display panel.

The control device 50 includes an image formation control unit 501 that controls the operation of the image forming device 2, an image processing unit 502 that prepares image data in accordance with a printing processing request, a power supply device 503, and the like. The image processing unit 502 converts printing information input from an external information transmitting device (for example, personal computer or like) into image information for formation of a latent image and outputs a drive signal to the exposure devices 12 at a pre-set timing. The exposure devices 12 of the present exemplary embodiment are composed of an LED head in which light emitting diodes (LED) are linearly arranged.

The power supply device 503 applies a predetermined high voltage for image formation to the photoreceptor units 13, the developing devices 14, the transfer device 15, and the like and supplies electric power to the exposure devices 12, the fixing device 16, and the like.

The paper feeding device 20 accommodates a large number of paper sheets P and the paper sheets P, of which a width direction is positioned by a regulation plate (not shown), are drawn out in a forward direction (direction −X) by a paper drawer unit 22 in a one-by-one manner from top to bottom and are transported to a nip portion of a pair of resist rollers 23.

The manual insertion paper feeding device 70 is foldable with respect to an opening and closing member 90 and feeds, to the nip portion of the pair of resist rollers 23, recording materials such as a paper sheet having a non-standard size, a specific thick paper sheet, a postcard, a long sheet longer than a normal-size sheet, a plastic film, and the like which are difficult for the paper feeding device 20 to feed.

The paper sheet P fed from the paper feeding device 20 or the manual insertion paper feeding device 70 is transported to the pair of resist rollers 23 and is transported to a secondary transfer nip portion in a state where tip ends thereof are aligned by the pair of resist rollers 23.

The photoreceptor units 13 are provided in parallel above the paper feeding device 20 and include photoreceptor drums that are rotationally driven. On the respective photoreceptor drums 31 on which electrostatic latent images are formed by the exposure devices 12, yellow (Y), magenta (M), cyan (C), and black (K) toner images are formed by the respective developing devices 14.

The respective color toner images formed on the photoreceptor drums 31 of the respective photoreceptor units 13 are electrostatically transferred (primary transfer) onto an intermediate transfer belt 51 of the transfer device 15 in a sequential manner so that a superimposition toner image obtained by respective color toners being superimposed onto each other is formed. The superimposition toner image on the intermediate transfer belt 51 is collectively transferred by a secondary transfer roller 52 to the paper sheet P that is fed from the pair of resist rollers 23 and guided by a transportation guide.

The fixing device 16 has a heating module 61 and a pressure module 62 which form a pair and a fixation nip portion NP (fixation region) is formed in a pressure contact region between the heating module 61 and the pressure module 62. The paper sheet P onto which the toner images are collectively transferred at the transfer device 15 is transported to the fixation nip portion NP of the fixing device 16 in a state where the toner images are not fixed and the toner images are fixed by being heated and crimped.

The paper sheet P on which a fixed toner image is formed is guided by switching gates G1 and G2 and is discharged to the relay device 4 from a first pair of discharge rollers 63 on a lower side, which is a part of pairs of discharge rollers vertically arranged, the relay device 4 being disposed in an in-body space S of the image forming device 2. In addition, the paper sheet P is discharged toward an upper surface 4*a* of the relay device 4 from a second pair of discharge rollers 64 with the position of the switching gate G1 being switched.

(1.2) Configuration and Operation of Post-Processing Device, Relay Device, and Recording Material Processing Apparatus The relay device 4 has inlet rollers 41 that receive the paper sheet P output via the first pair of discharge rollers 63 of the image forming device 2, first transportation rollers 42, 42 that transport the paper sheet P received by the inlet rollers 41 to a downstream side, and second transportation rollers 43 that transport the paper sheet P toward the post-processing device 3.

The post-processing device 3 includes receiving rollers 301 that receive the paper sheet P output from the image forming device 2 via the relay device 4, a compile tray 310 into which a plurality of the paper sheets P are collected and accommodated, discharge rollers 302 which are a pair of rollers discharging the paper sheet P toward the compile tray 310, paddles 303 that rotate to press the paper sheet P toward an end guide 310*b* of the compile tray 310, and a tamper 305 for alignment of end portions of the paper sheets P on the compile tray 310.

Furthermore, the post-processing device 3 has a binding mechanism 320 that binds end portions of a bundle of paper sheets composed of a plurality of paper sheets accumulated in the compile tray 310.

A bundle of paper sheets bundled on the compile tray 310 or a bundle of paper sheets bound by the binding mechanism 320 are transported and ejected by ejecting rollers 304.

On a side surface side of the post-processing device 3, a stacker tray TR onto which a bundle of paper sheets discharged by the ejecting rollers 304 is stacked such that the user picks a paper sheet easily and that is lifted and lowered vertically (in direction Z (refer to arrow in FIG. 1)) is provided.

Above the ejecting rollers 304, in a housing of the post-processing device 3, the recording material processing apparatus 5, which aligns end surfaces of a bundle of paper sheets that is discharged onto the stacker tray TR by the ejecting rollers 304, is disposed as an integrated unit. The recording material processing apparatus 5 includes guide shafts 510 that extend in the width direction of the paper sheet P which intersects a discharge direction of the paper sheet P and alignment devices 520 as alignment units movably held by the guide shafts 510. As shown in FIG. 2, alignment portions 523 of the alignment devices 520 come into contact with end surfaces Pa from outer sides of the paper sheets P discharged onto the stacker tray TR such that the end surfaces Pa of the paper sheets P are aligned (direction Y (refer to arrow R in FIG. 2)).

(2) Recording Material Processing Apparatus

Figure 3:
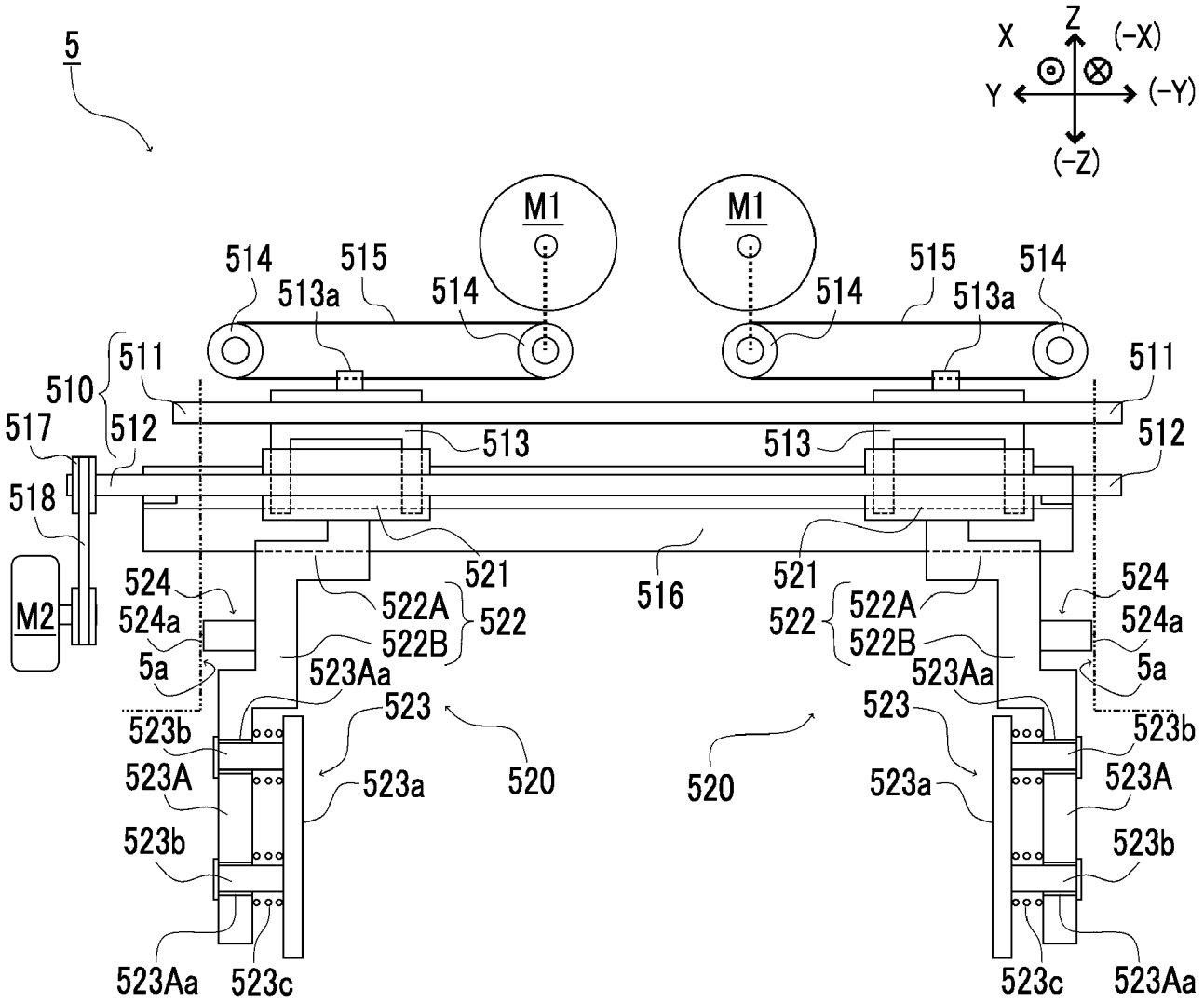
FIG. 3 is a schematic exploded plan view showing the entire configuration of the recording material processing apparatus in a plan view.
Figure 4A:
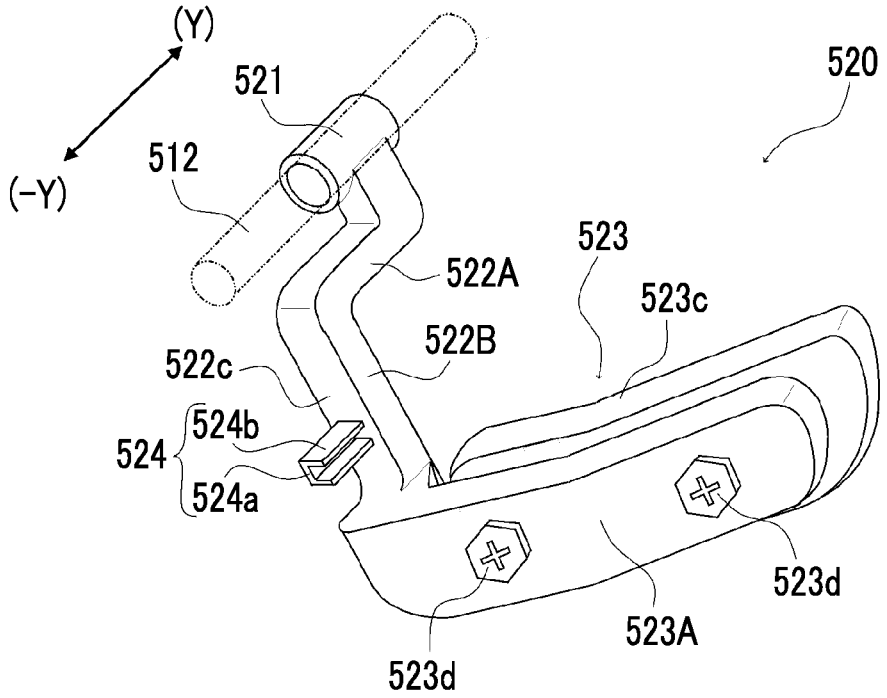
FIG. 4A is a perspective view showing an alignment device and FIG. 4B is a partial cross-sectional view for describing the configuration of the alignment portion of the alignment device.
Figure 4B:
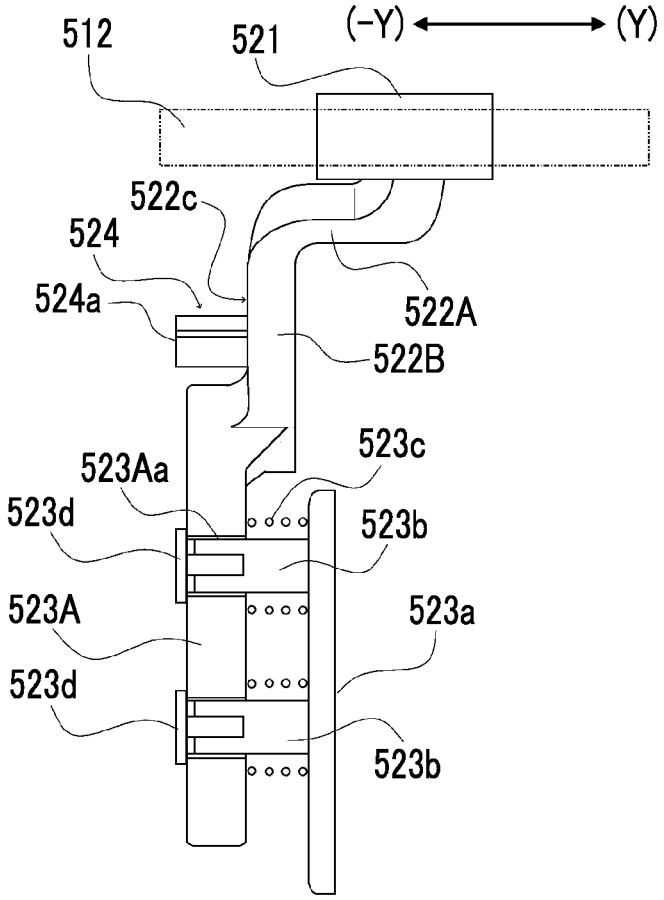
Figure 5A:
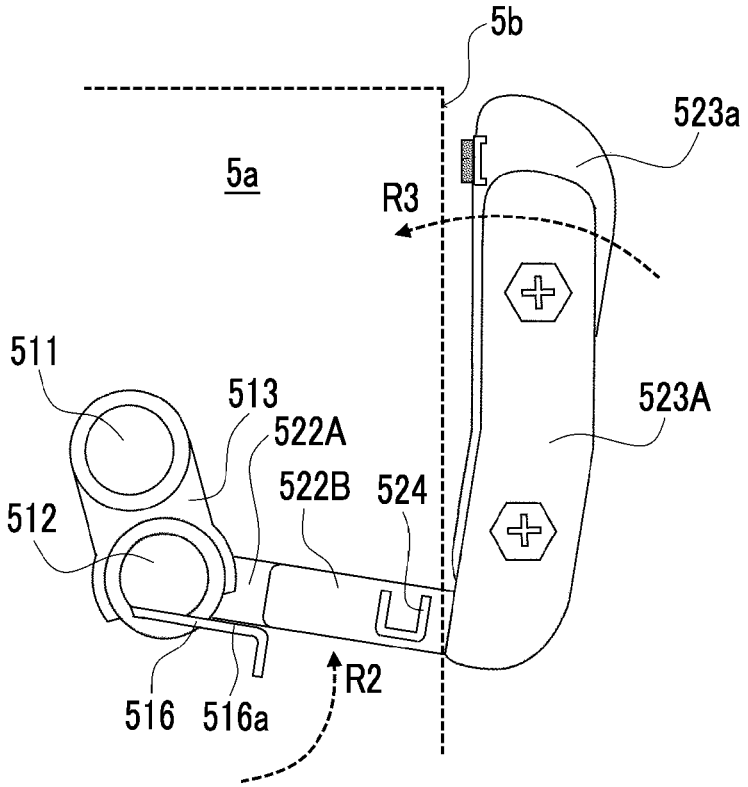
FIG. 5A is a side view showing a state where the alignment devices are rotated toward a device main body side and FIG. 5B is a side view showing a state where the alignment devices are rotated in a recording material discharge direction from the device main body side to perform an alignment operation.
Figure 5B:
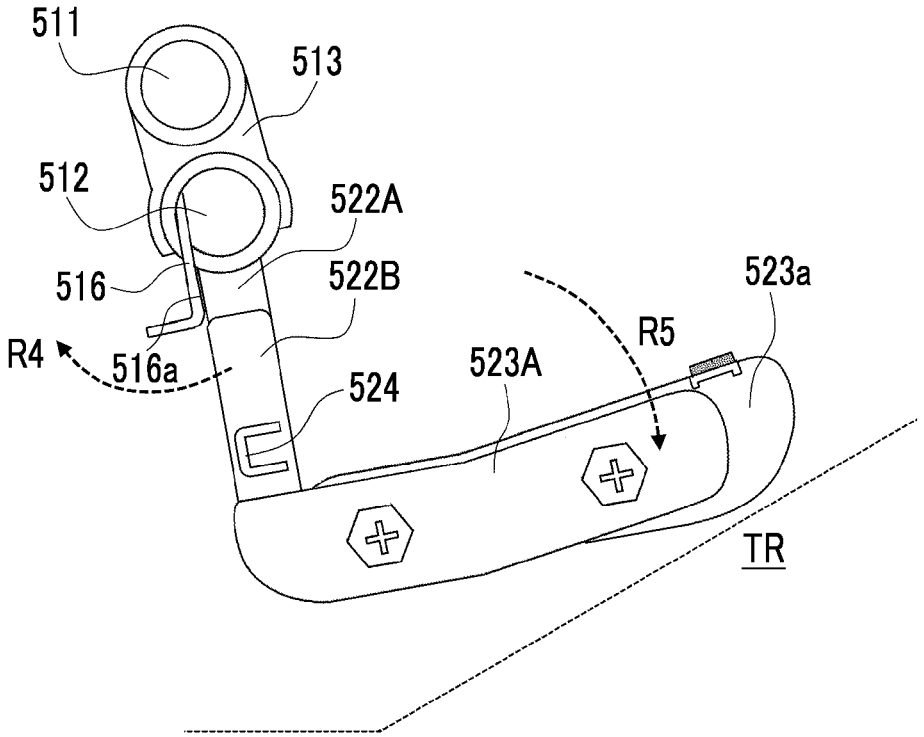
Figure 6:
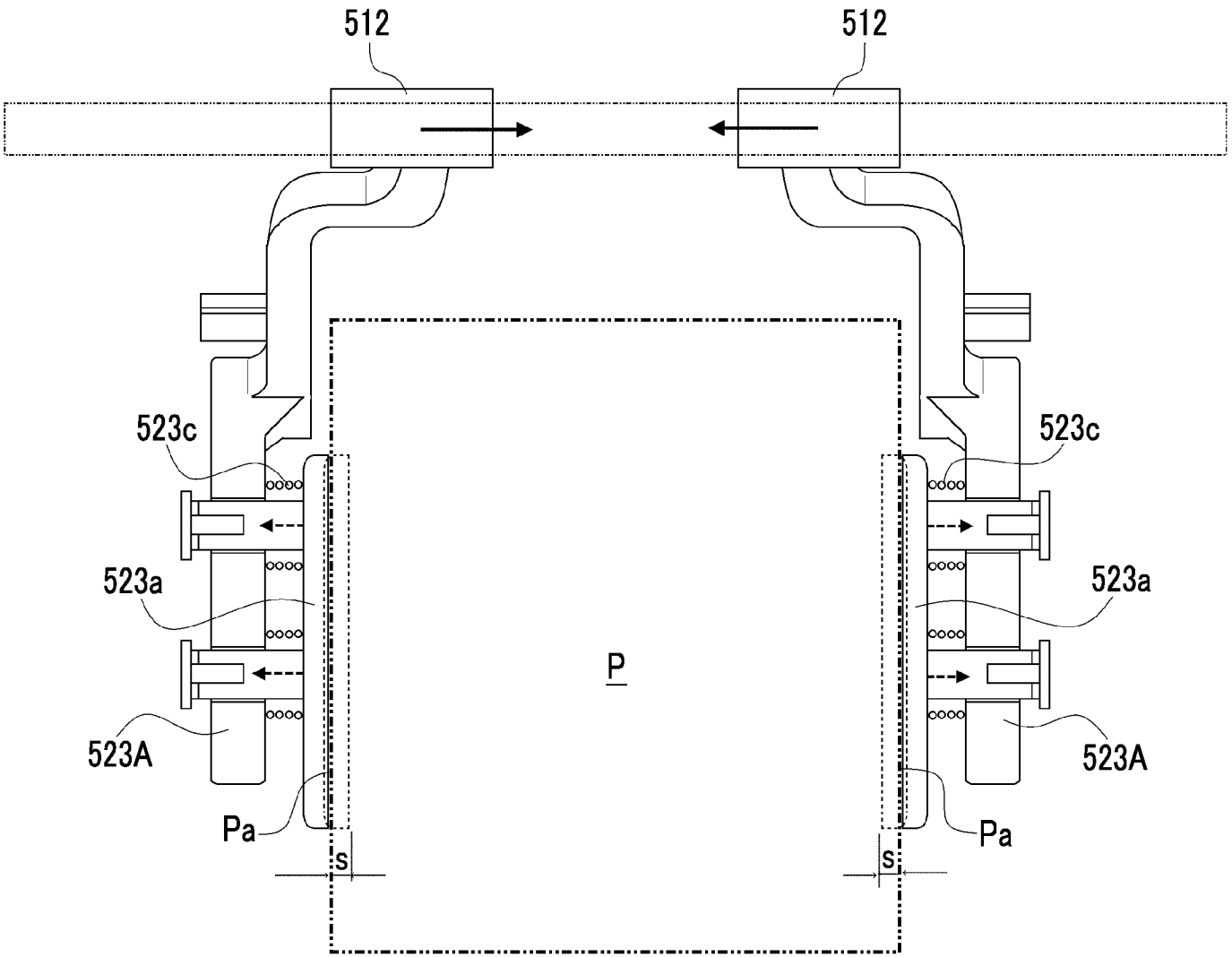
FIG. 6 is a view for describing alignment of end surfaces of paper sheets that is performed by the alignment devices.

FIG. 3 is a schematic exploded plan view showing the entire configuration of the recording material processing apparatus 5 in a plan view, FIG. 4A is a perspective view showing the alignment device 520, FIG. 4B is a partial cross-sectional view for describing the configuration of the alignment portion 523 of the alignment device 520, FIG. 5A is a side view showing a state where the alignment devices 520 are rotated toward a device main body side, FIG. 5B is a side view showing a state where the alignment devices 520 are rotated in a recording material discharge direction from the device main body side to perform an alignment operation, and FIG. 6 is a view for describing alignment of the end surfaces Pa of the paper sheets P that is performed by the alignment devices 520.

Hereinafter, the configuration and the operation of the recording material processing apparatus 5 will be described with reference to the drawings.

(2.1) Overall Configuration of Recording Material Processing Apparatus

As shown in FIG. 3, the recording material processing apparatus 5 includes the guide shafts 510 of which an axial direction extends in a paper sheet width direction (direction Y, direction −Y) intersecting (orthogonal to) the discharge direction of the paper sheet P and the alignment devices 520 as alignment units moving along the guide shafts 510.

The guide shafts 510 include a first guide shaft 511 and a second guide shaft 512, which are shafts formed of metal, and both end portions of the guide shafts 510 are fixed to the device main body. Support bases 513 are slidably fitted onto the first guide shaft 511 and one end 513*a* of each support base 513 is fixed to a timing belt 515 that is stretched by pulleys 514 in the axial direction of the first guide shaft 511. One of the pulleys 514 is connected to a rotary shaft of a motor M1 and rotation of the motor M1 causes the timing belt 515 to rotate and the support base 513 to move along the first guide shaft 511.

The second guide shaft 512 is disposed to be parallel with the first guide shaft 511 and the alignment devices 520 are slidably fitted onto the second guide shaft 512 while being supported by the support bases 513 and forming a left-and-right pair such that the alignment devices 520 face each other. Accordingly, in a case where the support bases 513 move in the axial direction of the first guide shaft 511 due to rotation of the motors M1, the alignment devices 520 move along the second guide shaft 512 such that an interval between the alignment devices 520 is narrowed or widen.

Each alignment device 520 is configured such that a bearing portion 521 that is slidably and movably fitted onto the second guide shaft 512, the alignment portion 523 that is provided to be exposed at an outer side in the discharge direction (direction X) and comes into contact with the end surfaces Pa parallel to the discharge direction of the paper sheets P from an outer side (direction −Y) to align the positions of the end surfaces Pa, an arm portion 522 that connects the bearing portion 521 and the alignment portion 523 to each other, and a protruding portion 524 that protrudes from a surface 522*c* (shown in FIG. 4A) of the arm portion 522 to a position outside the paper sheets P in the axial direction of the second guide shaft 512 are integrated with each other.

In the present exemplary embodiment, a top portion 524*a* of the protruding portion 524 protruding from the surface 522*c* of the arm portion 522 comes into contact with a surface 5*a* (represented by broken line in FIG. 3) of the device main body, which is parallel to the discharge direction, earlier in a case where an external force is applied to the alignment device 520 with the alignment device 520 being at a position close to the surface 5*a* of the device main body. Therefore, damage to the bearing portion 521 or deformation of the alignment portion 523 is suppressed.

As shown in FIG. 4A, the arm portion 522 includes a first arm portion 522A that is bent to be positioned in a direction (direction −Y) away from the end surfaces Pa of the paper sheets P further than the bearing portion 521 as seen in an axial direction and a second arm portion 522B that integrally continues from the first arm portion 522A and supports the alignment portion 523. The bearing portion 521, the first arm portion 522A, the second arm portion 522B, a receiving portion 523A of the alignment portion 523, and the protruding portion 524 are integrally formed with each other by means of a synthetic resin such as polyacetal (POM).

As shown in FIG. 4B, the alignment portion 523 is attached to the receiving portion 523A, which is formed to integrally continue from one end of the second arm portion 522B, by means of screws 523*d* in a state where a contact portion 523*a* having a flat surface that comes into contact with the end surfaces Pa of the paper sheets P is movably inserted into insertion holes 523Aa of the receiving portion 523A by means of shaft portions 523*b* and the contact portion 523*a* is urged toward the end surfaces Pa of the paper sheets P via springs 523*c*.

As described above, the alignment portion 523 has a two-layer structure in which the contact portion 523*a* is movably urged relative to the receiving portion 523A by the springs 523*c* and that is thick in the axial direction of the second guide shaft 512. However, since the second arm portion 522B supporting the receiving portion 523A is curved in the axial direction of the second guide shaft 512 due to the first arm portion 522A, the alignment portion 523 can align the end surfaces Pa of the paper sheets P while coming into contact with the end surfaces Pa from a more outer position. In addition, in a case where the alignment portion 523 does not have the two-layer structure, the alignment portion 523 is thin and thus the alignment portion 523 can align the end surfaces Pa of the paper sheets P while coming into contact with the end surfaces Pa from a further outer position.

Further, the alignment portion 523 is positioned outside the bearing portion 521 in the axial direction of the second guide shaft 512. Accordingly, it is possible to reduce the size of the recording material processing apparatus 5 in the width direction while increasing the paper sheet width of a paper sheet to be processed.

A rotary plate 516 is fixed to the second guide shaft 512. As shown in FIG. 3, a pulley 517 is fixed to one end of the second guide shaft 512 and is connected to a motor M2 via a timing belt 518. Accordingly, in a case where the motor M2 rotates corresponding to a predetermined number of pulses, the second guide shaft 512 rotates and the rotary plate 516 rotates at the same time. As shown in FIG. 5A, in a case where the rotary plate 516 rotates (represented by arrow R2 in FIG. 5A), a bent portion 516*a* of the rotary plate 516 comes into contact with the first arm portions 522A from a lower side (direction −Z), the first arm portions 522A are lifted up, and the alignment portions 523 are rotated toward the device main body side (represented by arrow R3 in FIG. 5A).

In a case where the alignment devices 520 perform the alignment operation of the discharged paper sheets P, after the alignment portions 523 are moved in the axial direction (direction −Y, direction Y) by a predetermined distance in a state of being rotated toward the device main body side, the motor M2 rotates reversely corresponding to a predetermined number of pulses, the second guide shaft 512 rotates reversely, and the rotary plate 516 rotates reversely at the same time. As shown in FIG. 5B, in a case where the rotary plate 516 rotates reversely (represented by arrow R4 in FIG. 5B), the bent portion 516*a* of the rotary plate 516 is separated from the first arm portions 522A and thus the alignment portions 523 are rotated downward (direction −Z) due to the weight of the alignment portions 523 and face the end surfaces Pa of the paper sheets P (represented by arrow R5 in FIG. 5B).

As shown in FIG. 6, in a case where a pair of the alignment devices 520 having the alignment portions 523 configured as described above moves toward the end surfaces Pa of the paper sheets P along the second guide shaft 512 and the contact portions 523*a* come into contact with the end surfaces Pa of the paper sheets P to bite into the end surfaces Pa (represented by S in FIG. 6), the contact portions 523*a* act such that the end surfaces Pa of the paper sheets P are aligned with the springs 523*c* pressed toward the receiving portions 523A.

(2.2) Alignment Operation

Figure 7A:
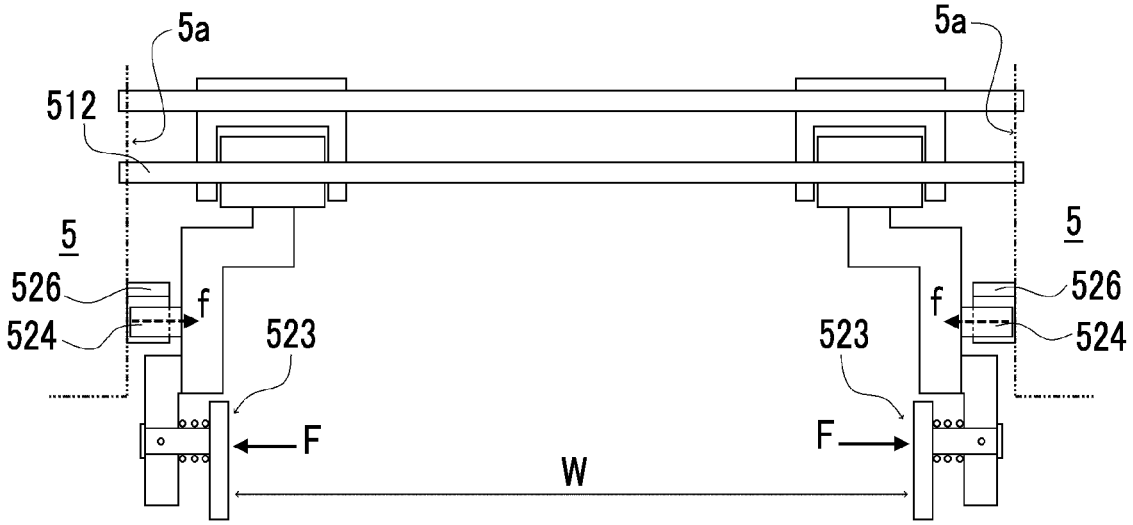
FIG. 7A is a plan view showing a state where the alignment devices are at standby positions and FIG. 7B is a side view showing the state where the alignment devices are at the standby positions.
Figure 7B:
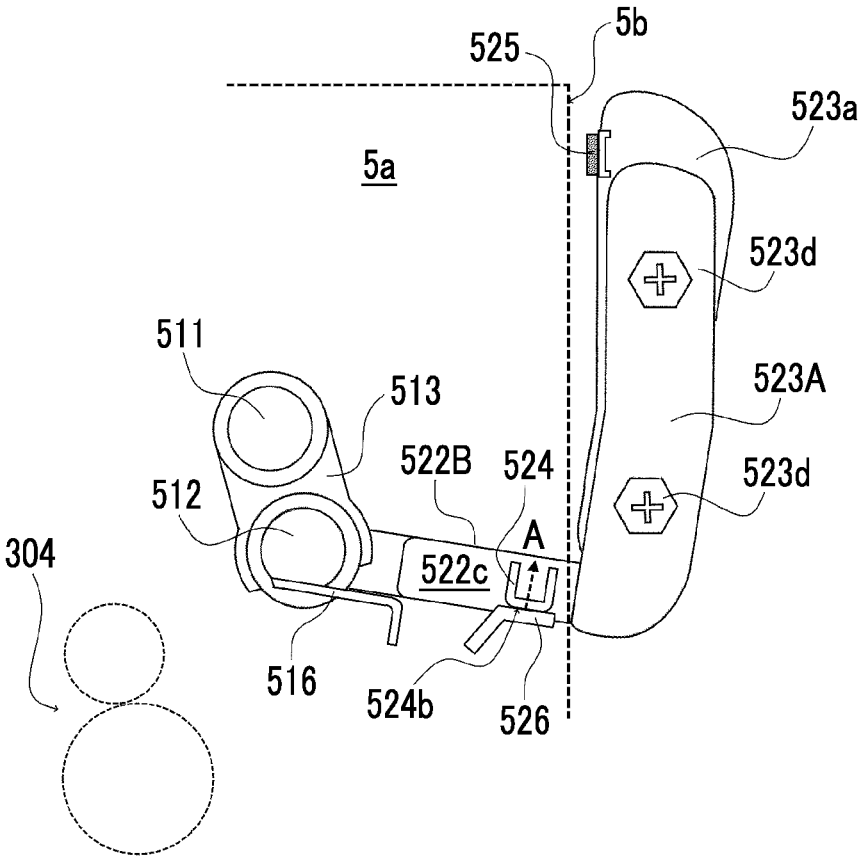
Figure 8A:
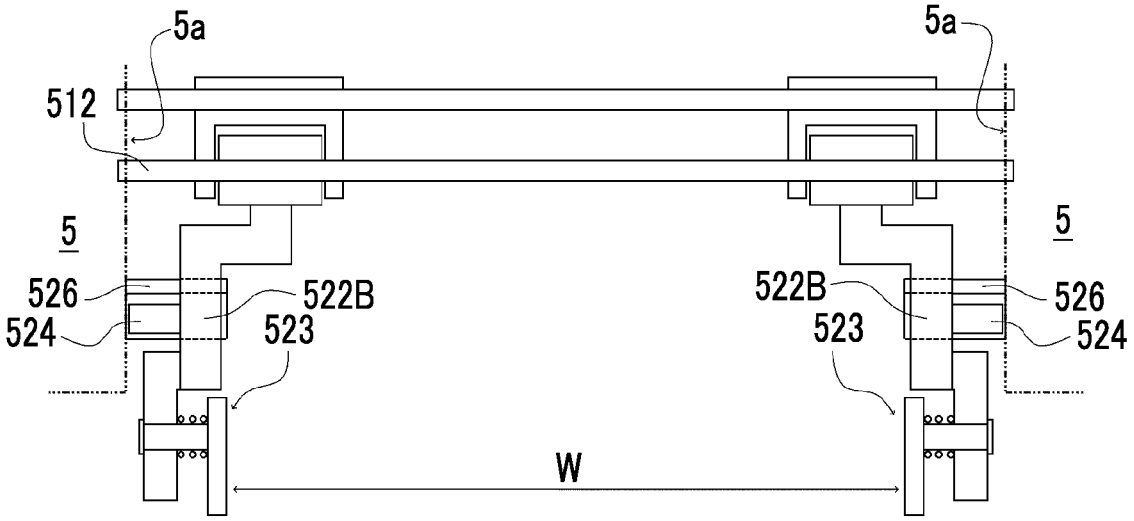
FIG. 8A is a plan view showing support portions in a modification example and FIG. 8B is a side view showing the support portions in the modification example.
Figure 8B:
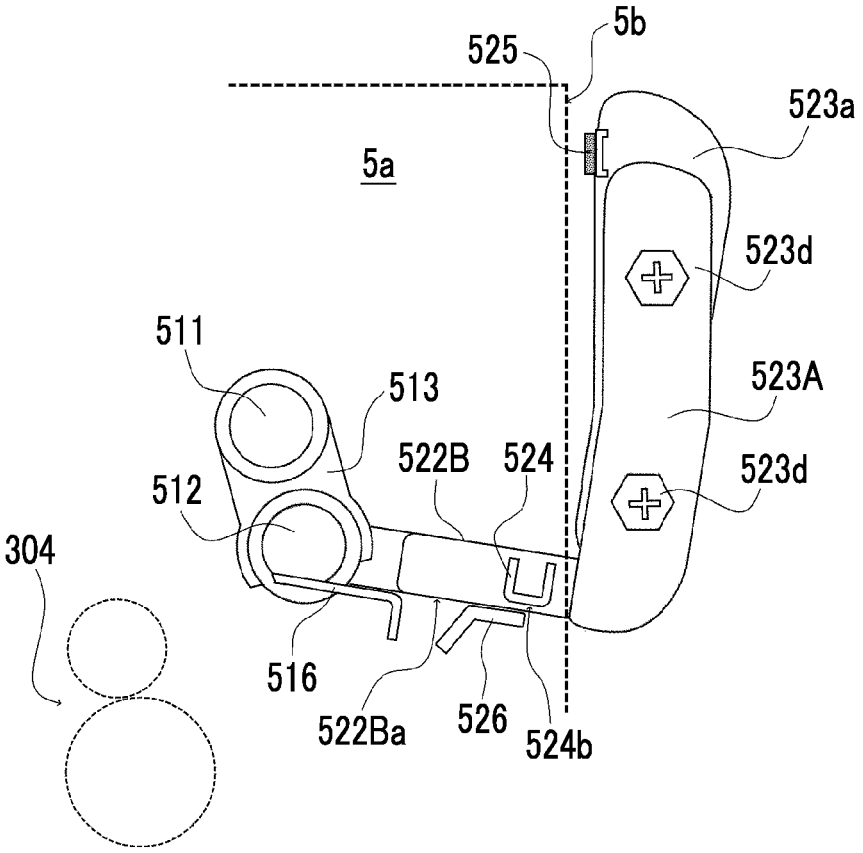
Figure 9A:
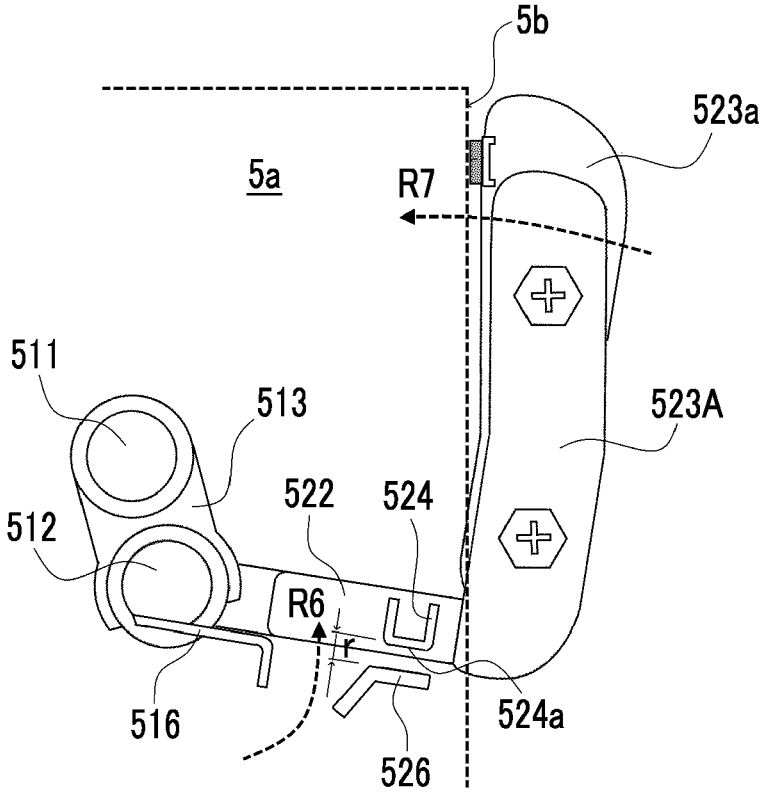
FIG. 9A is a side view showing a state where the alignment devices are moved to alignment positions and FIG. 9B is a plan view showing the state where the alignment devices are moved to the alignment positions.
Figure 9B:
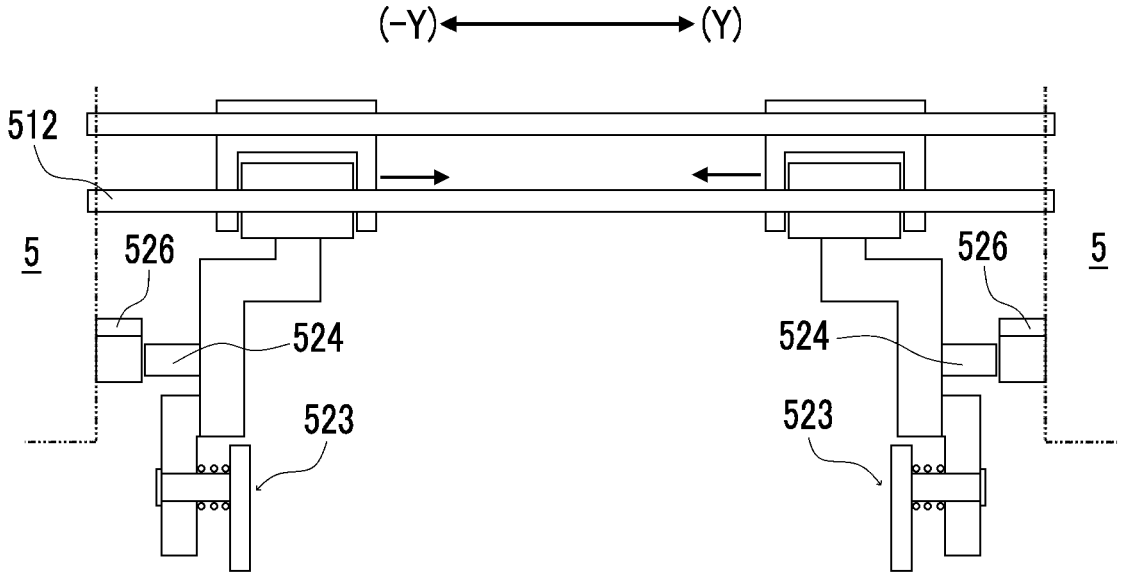
Figure 10A:
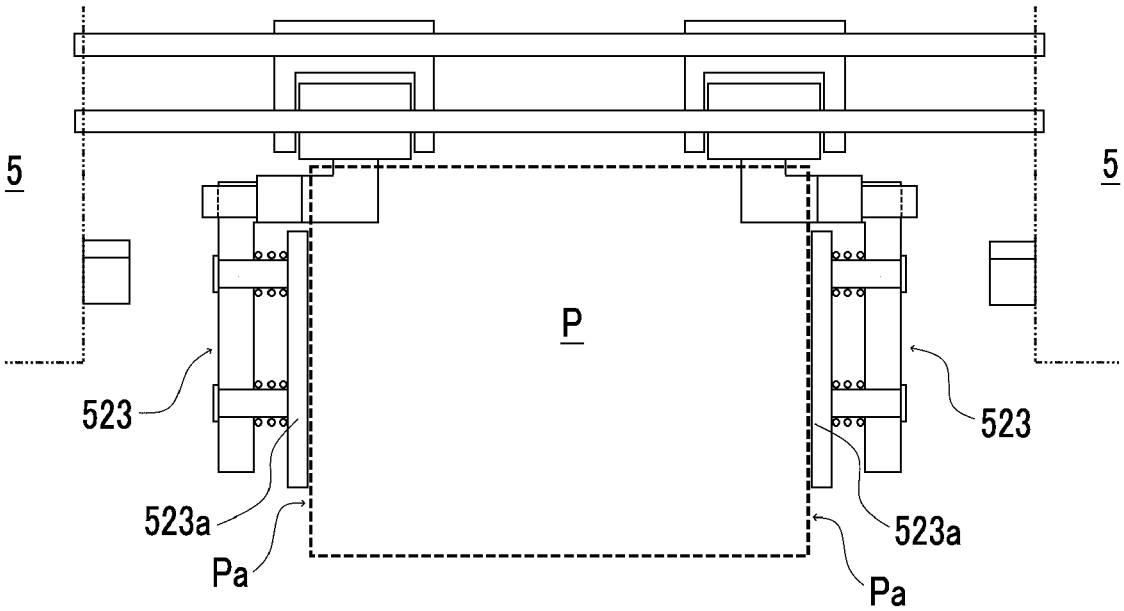
FIG. 10A is a plan view showing the alignment operation at the alignment positions and FIG. 10B is a side view showing the alignment operation at the alignment positions.
Figure 10B:
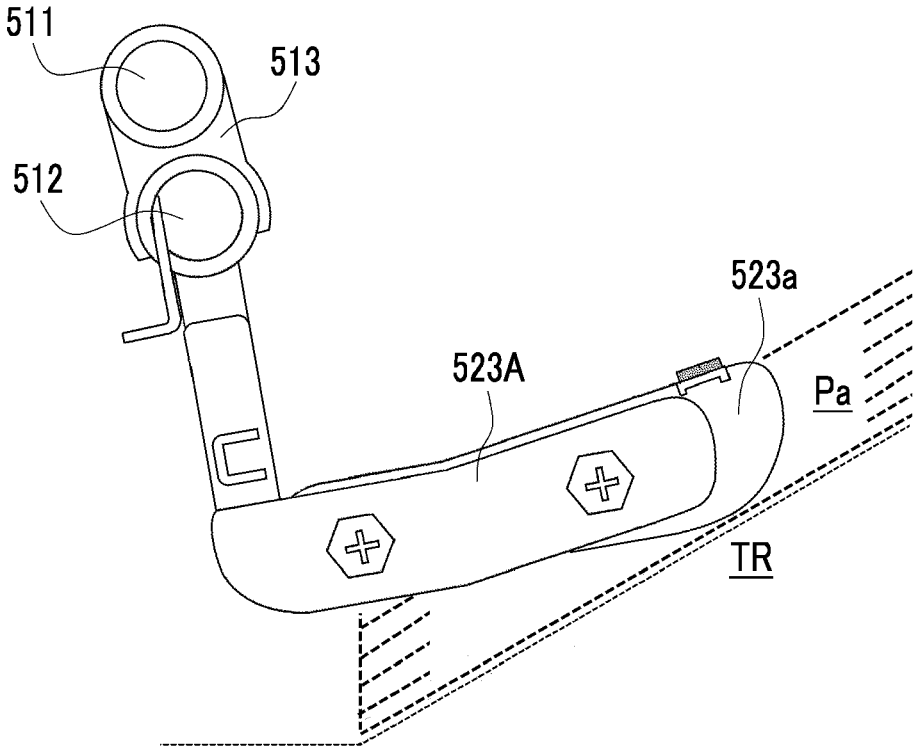

FIG. 7A is a plan view showing a state where the alignment devices 520 are at standby positions, FIG. 7B is a side view showing the state where the alignment devices 520 are at the standby positions, FIG. 8A is a plan view showing support portions 526 in a modification example, FIG. 8B is a side view showing the support portions 526 in the modification example, FIG. 9A is a side view showing a state where the alignment devices 520 are moved to alignment positions, FIG. 9B is a plan view showing the state where the alignment devices 520 are moved to the alignment positions, FIG. 10A is a plan view showing the alignment operation at the alignment positions, and FIG. 10B is a side view showing the alignment operation at the alignment positions.

(2.2.1) Standby Position

In a case where the paper sheets P discharged from the post-processing device 3 are received onto the stacker tray TR, the recording material processing apparatus 5 stands by at a standby position. As shown in FIG. 7A, the standby positions are positions at which the alignment portions 523 of the alignment devices 520 are maximally separated from the end surfaces Pa of the discharged paper sheets P in the axial direction of the second guide shaft 512 with the alignment devices 520 separated from each other at a predetermined facing interval W such that the paper sheets P can be received.

The alignment devices 520 can rotate around the axis of the second guide shaft 512 via the rotary plate 516 and in a case where the alignment operation is finished, the alignment portions 523 are moved to the standby positions in a state of being rotated toward the device main body side. Then, at the standby positions, as shown in FIG. 7B, the alignment portions 523 do not protrude considerably in the discharge direction of the paper sheets P with the alignment portions 523 rotated toward the device main body side to be nearly vertical. Accordingly, the alignment portions 523 are less likely to be touched from the outside and look compact in appearance.

The alignment portions 523 maintain a state of being rotated toward the device main body side with the first arm portions 522A lifted up from below due to rotation of the rotary plate 516 fixed to the second guide shaft 512. However, in a case where an external force is applied to the alignment portions 523, a load is applied to the rotary plate 516 and a load is also applied to the motor M2 which rotates the rotary plate 516.

In addition, in a case where an external force is applied to the alignment portions 523 and the rotary plate 516 is rotated in a direction −R2 beyond a position shown in FIG. 5A, there is a possibility of a change in position shown in FIG. 5B as well in a case where movement from FIG. 5A to FIG. 5B controls only the amount of rotation of the rotary plate 516 or the like, for example. In this case, a positional relationship between the alignment portions 523 and paper sheet side surfaces may be changed and alignment may become difficult to perform.

In the present exemplary embodiment, as shown in FIGS. 7A and 7B, support portions 526 that protrude in the axial direction (direction Y) are provided at discharge direction upstream side portions of the surfaces 5*a* of the device main body which are parallel to the discharge direction of the paper sheets P.

As shown in FIG. 7B, each of the support portions 526 has an approximately L-shape in a cross-sectional view and comes into contact with a portion 524*b* between the top portion 524*a* of the protruding portion 524 and the surface 522*c* of the second arm portion 522B from below (represented by arrow A in FIG. 7B) to support the alignment device 520 at the standby position such that the alignment device 520 does not rotate to an alignment position due to the weight of the alignment device 520.

As shown in FIGS. 8A and 8B, the support portions 526 may be formed to protrude to be long in the axial direction (direction Y) from the surfaces 5*a* of the device main body and may receive lower surfaces 522Ba of the second arm portions 522B. Deformation of the protruding portions 524 may be prevented with the second arm portions 522B directly supported instead of the protruding portions 524.

Since the support portions 526 are provided at the discharge direction upstream side portions of the surfaces 5*a* of the device main body which are parallel to the discharge direction of the paper sheets P, the appearance of the device is made favorable and the support portions 526 are less likely to be touched from the outside. In addition, since each of the support portions 526 has the approximately L-shape in a cross-sectional view, the support portions 526 are less likely to be broken even in a case where a load due to rotation or the like of the alignment devices 520 caused by the weight of the alignment devices 520 is applied thereto.

As described above, the standby positions are positions, at which the alignment portions 523 of the alignment devices 520 are maximally separated from the end surfaces Pa of the discharged paper sheets P in the axial direction of the second guide shaft 512 and the alignment portions 523 do not protrude considerably in the discharge direction of the paper sheets P with the alignment portions 523 rotated toward the device main body so that the alignment portions 523 are less likely to be touched from the outside.

In addition, at the standby positions, as shown in FIG. 7B, the alignment portions 523 do not face the surfaces 5*a* of the device main body even in a state of being rotated toward the device main body and top portions of the screws 523*d* with which the contact portions 523*a* of the alignment portions 523 are attached to the receiving portions 523A do not interfere with the surfaces 5*a* of the device main body.

As shown in FIG. 7B, elastic members 525 are provided near tip ends of the alignment portions 523. The elastic members 525 are formed of, for example, a foam material, and come into contact with surfaces 5*b* of the device main body so that damage to the device main body is suppressed in a case where the alignment devices 520 are rotated toward the device main body.

At the standby positions, the top portions 524*a* of the protruding portions 524 come into contact with the surfaces 5*a* of the device main body which are parallel to the discharge direction of the paper sheets P in a case where an external force is applied to the alignment devices 520. As shown in FIG. 4A, each top portion 524*a* has a U-shape including a plurality of surfaces so that the strength of the protruding portion 524 coming into contact with the surface 5*a* is improved. Note that, the protruding portion 524 may have a hollowed square rod-like shape as a whole and the top portion 524*a* may have a quadrangular shape with four surfaces. In addition, the protruding portion 524 may have a columnar shape. In this case, for example, it is preferable that the column is made hollow such that the rigidity thereof is prevented from being high more than necessary.

In addition, in the above-described example, an example in which the top portion 524*a* includes a surface that comes into contact with the surfaces 5*a* to a certain degree has been described. However, the top portion 524*a* may come into point contact with the surface 5*a*. In a specific example of a case where the top portion 524*a* comes into point contact with the surface 5*a*, the protruding portion 524 may have a semicircular shape. In the case of a semicircular shape, the amount of protrusion from the surface 522*c* is small and thus rotation may be stopped at another portion in this case.

The protruding portions 524 protrude outward most among portions of the alignment devices 520 that face the surfaces 5*a* of the device main body and as shown in FIG. 7A, in a case where external forces (represented by arrows Fin FIG. 7A) are applied to the alignment portions 523, the top portions 524*a* of the protruding portions 524 come into contact with the surfaces 5*a* of the device main body first (represented by arrows f in FIG. 7A). Therefore, the bearing portions 521 and the receiving portions 523A of the alignment portions 523 do not come into contact with the surfaces 5*a* of the device main body and damage to the bearing portions 521 and deformation of the alignment portions 523 may be suppressed.

In addition, in the present exemplary embodiment, the protruding portions 524 do not protrude from the receiving portions 523A of the alignment portions 523 and protrude from the surfaces 522*c* of the second arm portions 522B of which the rigidity is lower than the rigidity of the receiving portions 523A. Therefore, a sound generated in a case where the top portions 524*a* of the protruding portions 524 come into contact with the surfaces 5*a* of the device main body is small, each second arm portion 522B is likely to be bent with one end of the first arm portion 522A as a base end, and deformation is likely to be absorbed. In addition, an impact is less likely to be transmitted to the alignment portions 523.

(2.2.2) Movement to Alignment Position

In a case where the alignment portions 523 are to be moved from the standby positions to alignment positions at which the alignment portions 523 come into contact with the end surfaces Pa of the paper sheets P discharged onto the stacker tray TR to align the end surfaces Pa of the paper sheets P, as shown in FIG. 9A, first, the rotary plate 516 is rotated (represented by arrow R6 in FIG. 9A) such that the alignment portions 523 are rotated toward the device main body (represented by arrow R7 in FIG. 9A) and the portions 524*b* between the top portions 524*a* of the protruding portions 524 and the surfaces 522*c* of the second arm portions 522B are separated from the support portions 526 provided on the surfaces 5*a* of the device main body (represented by r in FIG. 9A).

Then, as shown in FIG. 9B, in a case where the rotary plate 516 rotates reversely after the alignment portions 523 are moved to predetermined positions in the axial direction (direction −Y, direction Y) in a state of being rotated toward the device main body, the bent portion 516*a* of the rotary plate 516 is separated from the first arm portions 522A and thus the alignment portions 523 are rotated downward (direction −Z) due to the weight of the alignment portions 523 and face the end surfaces Pa of the paper sheets P.

(2.2.3) Alignment Operation

In a case where the alignment portions 523 are moved to the alignment positions, as shown in FIGS. 10A and 10B, the contact portions 523*a* of the alignment portions 523 come into contact with the end surfaces Pa of the paper sheets P from outer sides in a tapping manner to align the paper sheets P.

(2.2.4) Movement to Standby Position

In a case where the alignment operation is finished, the rotary plate 516 rotates such that the alignment portions 523 are moved to the standby positions in a state of being rotated toward the device main body.

In a case where the alignment portions 523 are moved to the standby positions, the rotary plate 516 rotates reversely, the alignment portions 523 are rotated downward (direction −Z) due to the weight of the alignment portions 523, and the portions 524*b* between the top portions 524*a* of the protruding portions 524 and the surfaces 522*c* of the second arm portions 522B come into contact with the support portions 526 so that the alignment devices 520 are supported to be prevented from rotating to the alignment positions due to the weight of the alignment devices 520.

At the standby positions, in a case where the external forces are applied to the alignment portions 523, the top portions 524*a* of the protruding portions 524 come into contact with the surfaces 5*a* of the device main body first. Therefore, the bearing portions 521 and the receiving portions 523A of the alignment portions 523 do not come into contact with the surfaces 5*a* of the device main body and damage to the bearing portions 521 and deformation of the alignment portions 523 are suppressed.

In the above-described exemplary embodiment, a case where each arm portion 522 includes the first arm portion 522A and the second arm portion 522B has been described. However, the arm portion 522 may be straight.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

a guide shaft of which an axial direction extends in a recording material width direction intersecting a discharge direction of a recording material; and an alignment unit that moves along the guide shaft, wherein the alignment unit includes a bearing portion that is movably fitted onto the guide shaft, an alignment portion that is provided to be exposed at an outer side in the discharge direction and comes into contact with an end surface of the recording material that is parallel to the discharge direction from an outer side of the recording material to align a position of the end surface, an arm portion that connects the bearing portion and the alignment portion to each other, and a protruding portion that protrudes from a surface of the arm portion to a position outside the recording material in the axial direction of the guide shaft and comes into contact with a surface of a device main body, which is parallel to the discharge direction, in a case where an external force is applied to the alignment unit with the alignment unit being at a position close to the surface of the device main body, wherein a support portion that comes into contact with a portion between a top portion of the protruding portion that comes into contact with the surface of the device main body and the surface of the arm portion in a case where the alignment portion is at a standby position to support the alignment unit such that the alignment unit does not rotate is provided.

2. The recording material processing apparatus according to claim 1, wherein the alignment portion is supported by the arm portion at a position outside the bearing portion in the axial direction of the guide shaft, the aim portion is bent in the axial direction, and the protruding portion is formed to protrude from the surface of the arm portion that is on an outer side in the axial direction.

3. The recording material processing apparatus according to claim 2, wherein the top portion of the protruding portion that comes into contact with the surface of the device main body is disposed outside the alignment portion in the axial direction.

4. The recording material processing apparatus according to claim 3, wherein a surface of the top portion that comes into contact with the surface of the device main body is composed of a plurality of surfaces.

5. The recording material processing apparatus according to claim 4, wherein the alignment portion is rotatable around the guide shaft, and the standby position of the alignment portion is a position at which the alignment portion is close to the surface of the device main body that is parallel to the discharge direction.

6. The recording material processing apparatus according to claim 3, wherein the alignment portion is rotatable around the guide shaft, and the standby position of the alignment portion is a position at which the alignment portion is close to the surface of the device main body that is parallel to the discharge direction.

7. The recording material processing apparatus according to claim 6, wherein the support portion is provided upstream of the surface of the device main body in the discharge direction of the recording material.

8. The recording material processing apparatus according to claim 2, wherein the alignment portion is rotatable around the guide shaft, and the standby position of the alignment portion is a position at which the alignment portion is close to the surface of the device main body that is parallel to the discharge direction.

9. The recording material processing apparatus according to claim 8, wherein the support portion is provided upstream of the surface of the device main body in the discharge direction of the recording material.

10. The recording material processing apparatus according to claim 1, wherein the top portion of the protruding portion that comes into contact with the surface of the device main body is disposed outside the alignment portion in the axial direction.

11. The recording material processing apparatus according to claim 10, wherein a surface of the top portion that comes into contact with the surface of the device main body is composed of a plurality of surfaces.

12. The recording material processing apparatus according to claim 11, wherein the alignment portion is rotatable around the guide shaft, and the standby position of the alignment portion is a position at which the alignment portion is close to the surface of the device main body that is parallel to the discharge direction.

13. The recording material processing apparatus according to claim 12, wherein the support portion is provided upstream of the surface of the device main body in the discharge direction of the recording material.

14. The recording material processing apparatus according to claim 10, wherein the alignment portion is rotatable around the guide shaft, and the standby position of the alignment portion is a position at which the alignment portion is close to the surface of the device main body that is parallel to the discharge direction.

15. The recording material processing apparatus according to claim 14, wherein the support portion is provided upstream of the surface of the device main body in the discharge direction of the recording material.

16. The recording material processing apparatus according to claim 1, wherein the alignment portion is rotatable around the guide shaft, and the standby position of the alignment portion is a position at which the alignment portion is close to the surface of the device main body that is parallel to the discharge direction.

17. The recording material processing apparatus according to claim 16, wherein the support portion is provided upstream of the surface of the device main body in the discharge direction of the recording material.

18. The recording material processing apparatus according to claim 16, wherein the support portion has an approximately L-shape in a cross-sectional view as seen in the axial direction.

19. An image forming system comprising:

an image forming device that foams an image on a recording material;

a post-processing device that performs post-processing on the recording material on which the image is formed by the image forming device; and the recording material processing apparatus according to claim 1 that aligns a position of an end surface of the recording material subjected to the post-processing by the post-processing device, the end surface being parallel to a discharge direction of the recording material.

20. A recording material processing apparatus comprising:

a guide shaft of which an axial direction extends in a recording material width direction intersecting a discharge direction of a recording material; and an alignment unit that moves along the guide shaft, wherein the alignment unit includes a bearing portion that is movably fitted onto the guide shaft, an alignment portion that is provided to be exposed at an outer side in the discharge direction and comes into contact with an end surface of the recording material that is parallel to the discharge direction from an outer side of the recording material to align a position of the end surface, an aim portion that connects the bearing portion and the alignment portion to each other, and a protruding portion that protrudes from a surface of the arm portion to a position outside the recording material in the axial direction of the guide shaft and comes into contact with a surface of a device main body, which is parallel to the discharge direction, in a case where an external force is applied to the alignment unit with the alignment unit being at a position close to the surface of the device main body, wherein the alignment portion is provided with an elastic member that comes into contact with another surface of the device main body that faces an upstream side in the discharge direction of the recording material in a case of rotation toward the upstream side in the discharge direction of the recording material at a standby position.

* * * * *